US011292042B1

(12) United States Patent
Wilson

(10) Patent No.: US 11,292,042 B1
(45) Date of Patent: Apr. 5, 2022

(54) PULLING MEMBER

(71) Applicant: Confident & Competent, Inc., Oakley, IL (US)

(72) Inventor: Michael D. Wilson, Oakley, IL (US)

(73) Assignee: Confident & Competent, Inc., Oakley, IL (US)

( * ) Notice: Subject to any disclaimer, the term of this patent is extended or adjusted under 35 U.S.C. 154(b) by 57 days.

(21) Appl. No.: 17/021,231

(22) Filed: Sep. 15, 2020

(51) Int. Cl.
*B21C 37/15* (2006.01)
*B21D 31/00* (2006.01)
*B21C 37/29* (2006.01)

(52) U.S. Cl.
CPC ..... *B21C 37/155* (2013.01); *B21C 37/292* (2013.01); *B21D 31/00* (2013.01)

(58) Field of Classification Search
CPC ..... B21C 37/15; B21C 37/151; B21C 37/28; B21C 37/29; B21C 37/292; B21C 37/30; B21C 1/22; B21D 28/28; B21D 28/285; B21D 31/00; B21D 31/04; B21D 26/037; B21D 22/025; B21D 39/044; B21D 39/046; B21D 39/06; B21D 39/08; B21D 39/20; Y10T 29/49442
USPC ..... 72/347, 386, 370.27, 125, 339; 29/890.14, 890.148
See application file for complete search history.

(56) References Cited

U.S. PATENT DOCUMENTS 1,656,736 A * 1/1928 Kellogg ..... B21C 37/292 72/347
1,792,928 A 2/1931 Reigart
1,911,653 A 5/1933 Taylor
2,213,574 A * 9/1940 Weston ..... B21C 37/292 72/479
2,292,799 A * 8/1942 Romann ..... B21C 37/292 29/890.148
2,337,342 A * 12/1943 Nordgren ..... B21C 37/292 72/347
2,507,859 A * 5/1950 Keller ..... B21C 37/292 29/890.15
2,511,836 A * 6/1950 Cullen ..... B21C 37/292 228/154
2,670,224 A * 2/1954 Markl ..... B21C 37/292 285/133.11
2,859,870 A * 11/1958 Hitz ..... B21C 37/292 72/347
3,081,812 A * 3/1963 Brown ..... F16L 41/06 72/124
3,468,147 A * 9/1969 Davies ..... B21C 37/292 72/112
3,535,909 A 10/1970 Latham
(Continued)

FOREIGN PATENT DOCUMENTS

JP 5890323 A * 5/1983
JP 2000176556 A * 6/2000 ..... B21C 37/298
WO WO-9319863 A1 * 10/1993 ..... B21C 37/292

*Primary Examiner* — Adam J Eiseman
*Assistant Examiner* — P Derek Pressley
(74) *Attorney, Agent, or Firm* — Philip L. Bateman

(57) ABSTRACT

A two piece pulling member is used to form a branched opening with a shoulder in a side wall of a malleable pipe without requiring the pulling member to be inserted from an end of the pipe. The pulling member has a base and a top that are individually placed through the initial hole in the pipe. The base and the top are assembled into a unit inside the pipe.

11 Claims, 11 Drawing Sheets

(56) References Cited

U.S. PATENT DOCUMENTS

| | | | | |
|---|---|---|---|---|
| 3,587,163 | A * | 6/1971 | Horton | B21C 37/292<br>228/154 |
| 3,683,657 | A * | 8/1972 | Davies | B21C 37/29<br>72/112 |
| 4,106,322 | A * | 8/1978 | Moshnin | B21C 37/292<br>29/890.148 |
| 6,044,683 | A | 4/2000 | Shigemoto | |
| 6,430,812 | B1 * | 8/2002 | Sanders | B21C 37/292<br>29/890.148 |
| 6,860,517 | B2 | 3/2005 | Sanders | |

* cited by examiner

PULLING MEMBER

CROSS-REFERENCE TO RELATED APPLICATION

This application claims the benefit of U.S. Provisional Application Ser. No. 62/914,604, Oct. 14, 2019.

FIELD OF THE INVENTION

This invention relates to metal working and pipe joints. More particularly, this invention relates to the forming of a branched opening with a shoulder in a side wall of a malleable pipe.

BACKGROUND OF THE INVENTION

It is often necessary to add a transverse branched pipe to a larger diameter main pipe. One method for accomplishing this is shown in FIG. 1. The main pipe is cut in two places and the cut-out section is discarded. A prefabricated tee joint is then inserted into the empty space between the two remaining sections of pipe. Two circumferential welds are then required to attach the joint to the existing main pipe. A conventional pipe (not shown) is then attached to the joint.

Another method for adding a branched pipe is shown in FIGS. 2 to 4. This method is desirable because it requires only one circumferential weld. Referring first to FIG. 2, the first step is to cut a hole 80 in the side wall of the main pipe 70 near its end. The hole is slightly less in size than the desired size of the branched pipe. The hole is generally elliptical, but other shapes are also suitable. Referring to FIG. 3, the second step is to insert a steel cylindrical pulling member (also known as a plug, a former, or a die) into the main pipe. The pulling member has the size (diameter) of the desired branched opening. A threaded rod is then inserted through the hole and attached to the pulling member. The threaded rod is then attached to a pulling tool (not shown). Referring to FIG. 4, the pulling tool then pulls the pulling member through the hole with sufficient force to bend the malleable metal of the main pipe into a branched opening 90 with a shoulder and of the desired diameter. A conventional pipe is then attached to the opening by welding.

Forming an opening with a shoulder in a side wall of a pipe by pulling a cylindrical pulling member through a hole is disclosed in many references, including Reigart, U.S. Pat. No. 1,792,928, Feb. 17, 1931; Taylor, U.S. Pat. No. 1,911,653, May 30, 1933; Keller, U.S. Pat. No. 2,507,859, May 16, 1950; Latham, U.S. Pat. No. 3,535,909, Oct. 27, 1970; Shigemoto, U.S. Pat. No. 6,044,683, Apr. 4, 2000; and Sanders, U.S. Pat. No. 6,860,517, Mar. 1, 2005. A major limitation of this method is that the hole (and the resulting opening) must be located near an end of the main pipe so the pulling member can be inserted from the end and placed into position under the hole. In other words, the method cannot be used to form a branched opening in a main pipe at locations far from an end.

Accordingly, there is a demand for an improved apparatus for forming a branched opening with a shoulder in a side wall of a malleable pipe that does not require a pulling member to be inserted from an end of the pipe. There is also a demand for an improved assembly for forming a branched opening with a shoulder in a side wall of a malleable pipe that does not require a pulling member to be inserted from an end of the pipe. There is also a demand for an improved method for forming a branched opening with a shoulder in a side wall of a malleable pipe that does not require a pulling member to be inserted from an end of the pipe.

SUMMARY OF THE INVENTION

The general object of this invention is to provide an improved apparatus for forming a branched opening with a shoulder in a side wall of a malleable pipe that does not require a pulling member to be inserted from an end of the pipe. Another general object is to provide an improved assembly for forming a branched opening with a shoulder in a side wall of a malleable pipe that does not require a pulling member to be inserted from an end of the pipe. Another general object is to provide an improved method for forming a branched opening with a shoulder in a side wall of a malleable pipe that does not require a pulling member to be inserted from an end of the pipe.

I have invented an improved two piece cylindrical pulling member for forming a branched opening with a shoulder in a side wall of a malleable pipe. The pulling member comprises: (a) base having: (i) a square portion having an upwardly facing interior face, a central opening, front and rear opposed ends, and a depth about 50 percent of the depth of the pulling member; and (ii) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (b) a top having: (i) a square portion having a downwardly facing interior face, a central opening, left and right opposed ends, and a depth about 50 percent of the depth of the pulling member; and (ii) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder.

I have also invented an improved assembly for forming a branched opening with a shoulder in a side wall of a malleable pipe. The assembly comprises: (a) a two piece pulling member having a radius and a depth and comprising: (i) a base having: (1) a square portion having an upwardly facing interior face, a central circular opening, front and rear opposed ends, and a depth about 50 percent of the depth of the pulling member; and (2) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (ii) a top having: (1) a square portion having a downwardly facing interior face, a central circular opening, left and right opposed ends, and a depth about 50 percent of the depth of the pulling member; and (2) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder; and (b) a pulling tool subassembly comprising: (i) a rod for attachment to the pulling member; and (ii) a pulling tool for applying a pulling force to the pulling rod to pull the pulling member through a hole in a side wall of a malleable pipe to form a branched opening with a shoulder.

I have also invented an improved method for forming a branched opening with a shoulder in a side wall of a malleable pipe. The method comprises: (a) obtaining a malleable pipe with a hole in a side wall; (b) obtaining a two piece pulling member having a radius and a depth and comprising: (i) a base having: (1) a square portion having an upwardly facing interior face, a central circular opening, front and rear opposed ends, and a depth about 50 percent of the depth of the pulling member; and (2) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (ii) a top having: (1) a square portion having a downwardly facing interior face, a central circular opening, left and right opposed ends, and a depth about 50 percent of the depth of the pulling member; and (2) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder; and; (c) inserting the base of the pulling member through the hole in the pipe; (d) inserting the top of the pulling member through the hole in the pipe; (e) fitting the top of the pulling member onto the base of the pulling member with the interior face of the base and the interior face of the top in contact to form the pulling member; (f) attaching a pulling rod to the pulling member; and (g) pulling on the pulling rod to pull the pulling member through the hole to form a branched opening with a shoulder.

The apparatus, assembly, and method of this invention enable a branched opening with a shoulder in a side wall of a malleable pipe to be formed without requiring a pulling member to be inserted from an end of the pipe.

DETAILED DESCRIPTION OF THE INVENTION

1. Introduction

Figure 1:
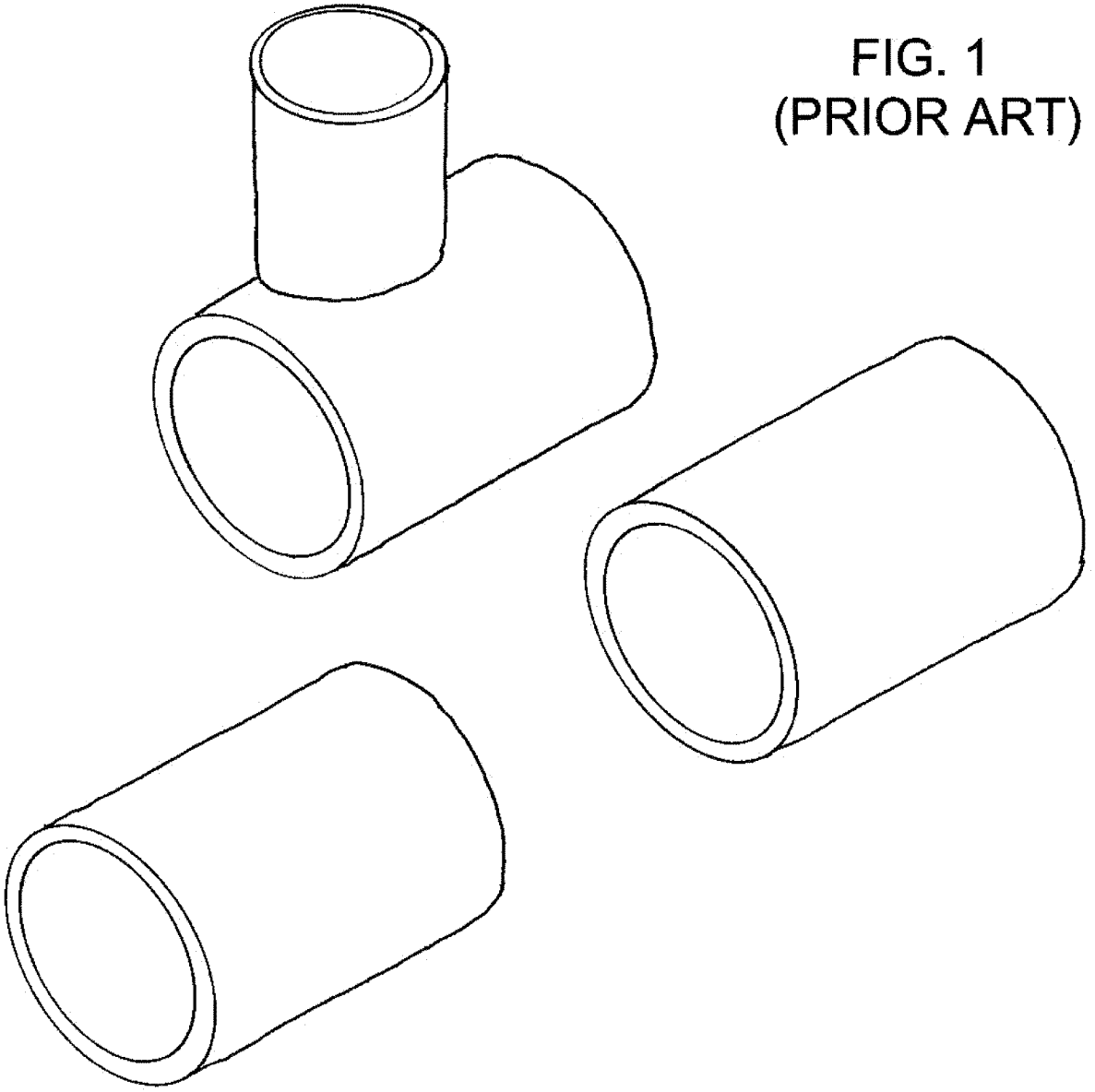
FIG. 1 (PRIOR ART)
FIG. 1 is a perspective view of a prior art installation of a branched pipe to a larger diameter main pipe.
Figure 4:
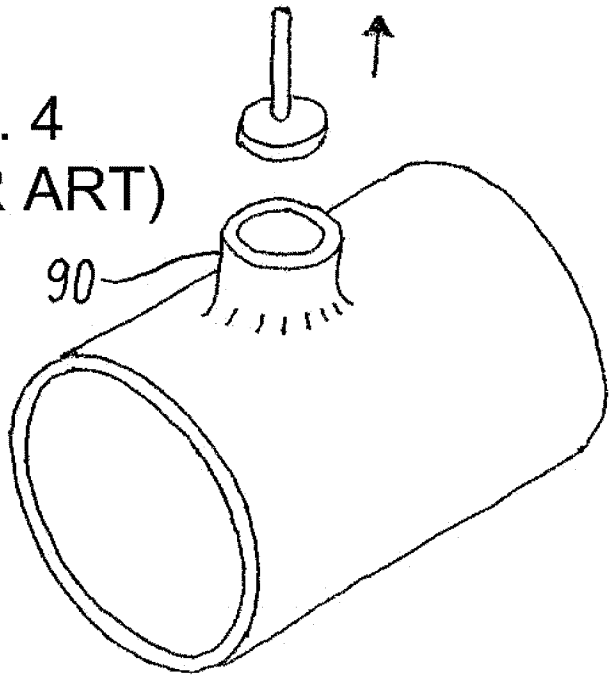
FIG. 4 (PRIOR ART)
FIG. 4 is a perspective view of a third step thereof.
Figure 2:
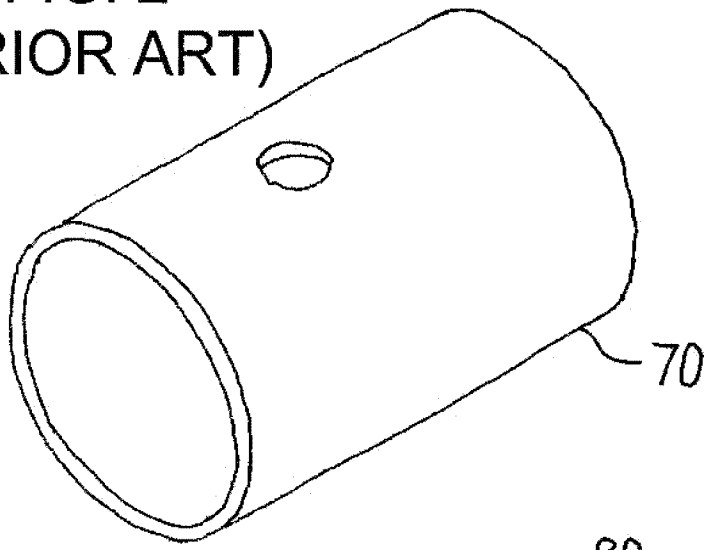
FIG. 2 (PRIOR ART)
FIG. 2 is a perspective view of a first step in the prior art installation of a branched pipe using a pulling member.
Figure 3:
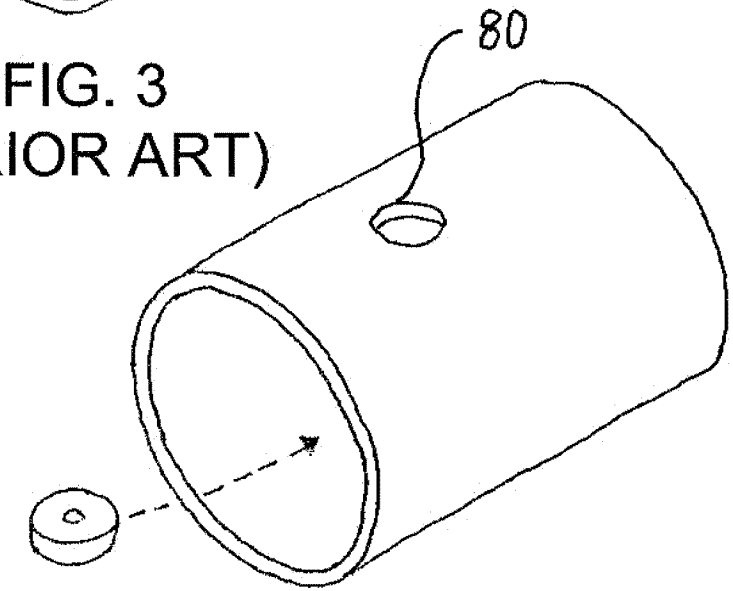
FIG. 3 (PRIOR ART)
FIG. 3 is a perspective view of a second step thereof.
Figure 6:
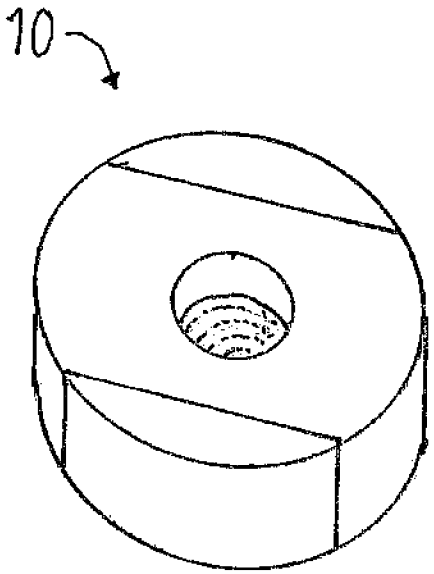
FIG. 6 is a perspective assembled view thereof.
Figure 5:
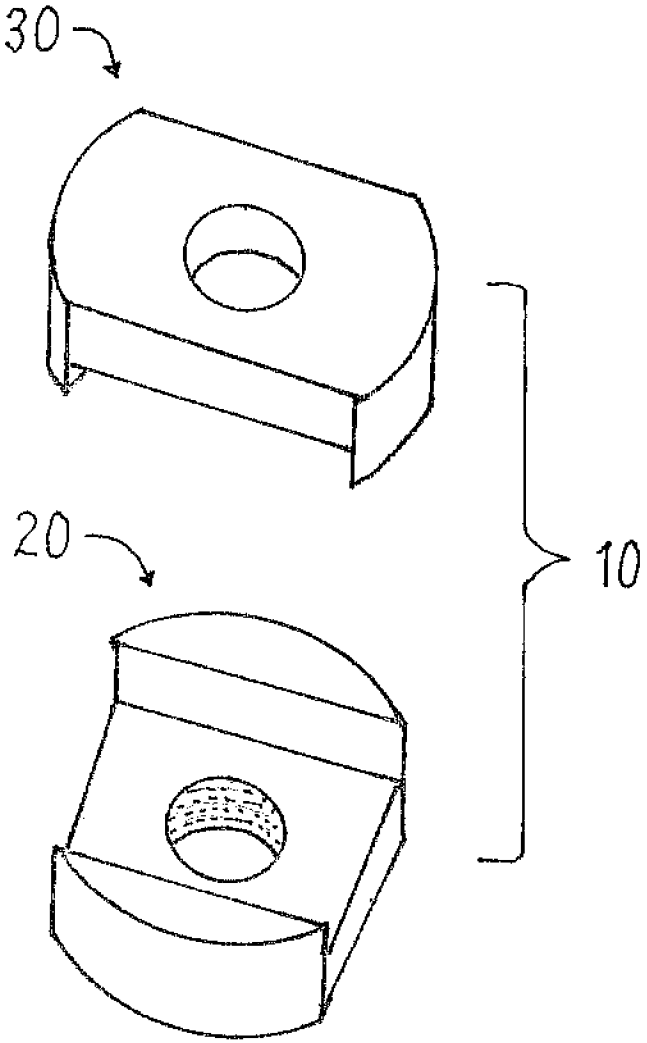
FIG. 5 is a perspective exploded view of a preferred embodiment of the two piece pulling member of this invention.

This invention is best understood by reference to the drawings. Referring first to FIG. 5, a preferred embodiment of the two piece pulling member 10 of this invention comprises a base 20 and a top 30. The base and top fit together as shown in FIG. 6 to form a combined cylindrical unit having the size (diameter) to form a branched opening with a shoulder and of the desired diameter. When not together, the base and the top fit individually through a hole having a diameter less than the diameter of the combined unit. As explained in detail below, this feature enables the two piece pulling member to be used to form a branched opening with a shoulder in a side wall of a malleable pipe without requiring the pulling member to be inserted from an end of the pipe.

2. The Base of the Pulling Member

The base 20 has an upper surface with a shape that is best described by using geometrical terms. It is understood that the various shapes referenced are the upper surfaces because the base is three-dimensional (having a depth) rather than two-dimensional. Accordingly, referencing a "square" is actually referencing a cube, referencing a "circle" is actually referencing a cylinder, etc. This same convention is used when describing the lower surface of the top 30.

Figure 7:
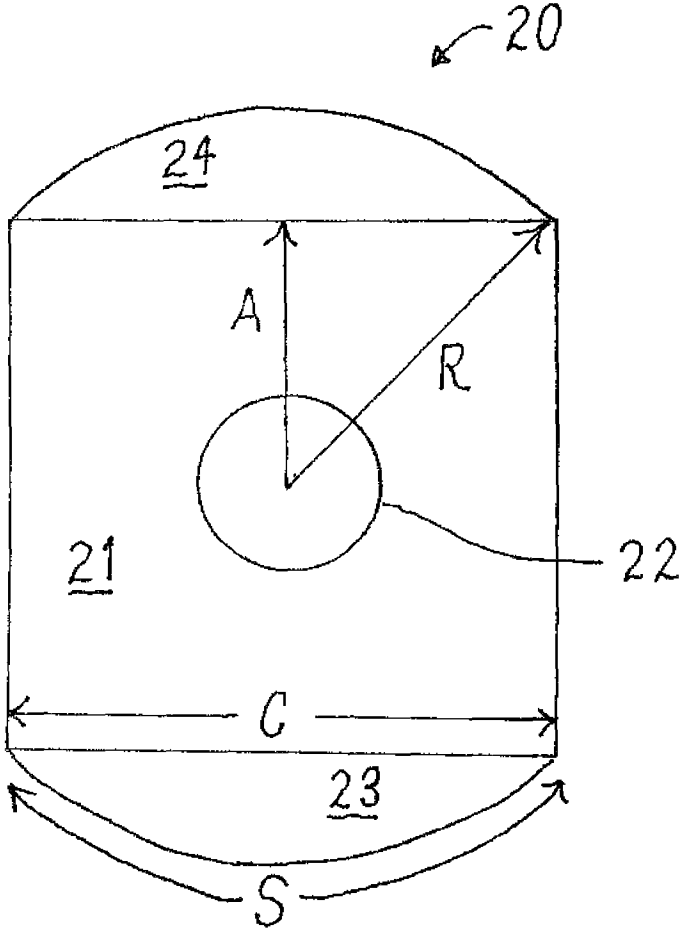
FIG. 7 is a top view of the base thereof.

Referring now to FIG. 7, the upper surface of the base has a generally square portion 21 with an upwardly facing interior face. The term "generally" means that slight variations from square are suitable, but not preferred. For example, if the base has a rectangular portion, the circular segments of the base and the top will be unequal in size and the smaller pair of the segments will be weaker than the larger pair of the segments. The depth of the square portion is about 50 percent of the overall depth of the pulling member. The term "about" is used herein to mean plus or minus 25 percent of the measurement or other quantified property referenced. The base has a central opening 22 for attachment of a pulling rod. The opening is preferably circular and threaded to mate with a threaded rod. Other means of attaching a pulling rod are also suitable.

The upper surface of the base has a front upwardly extending circular segment 23 and a rear upwardly extending circular segment 24. These two circular segments extend upwardly above the square portion of the base as best seen in FIG. 5. The two segments and the square portion form a generally flush lower surface. The depth of each circular segment is equal to the overall depth of the pulling member.

Each circular segment is bounded by a chord C and an arc S of 90 degrees (0.5 radians) having the radius R of the pulling member. The apothem A of each circular segment (the shortest distance from the center of the circular opening to the chord) is 0.707 percent of the radius (the cosine of 45 degrees). The number 0.707 is also the square root of 0.5 as provided by the Pythagorean theorem for a right triangle whose hypotenuse is 1.0. The outer upper edge of the circular segments of the base are preferably rounded slightly to provide a smoother movement through the pipe and to provide a smoother finished opening.

3. The Top of the Pulling Member

Figure 8:
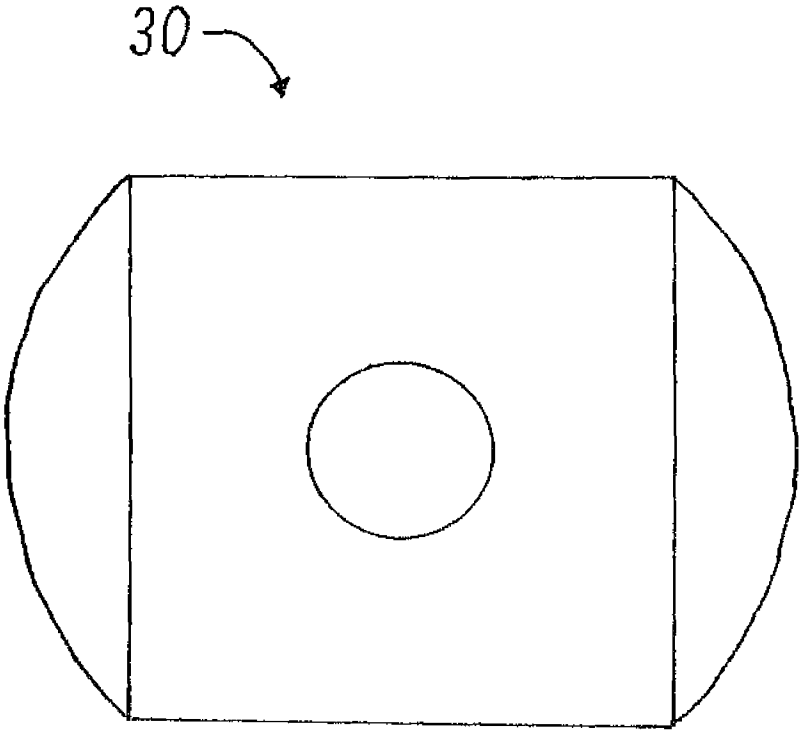
FIG. 8 is a bottom view of the top thereof.

Referring now to FIG. 8, the top 30 is similar in shape to the base with the following exceptions. First, its central circular opening 32 is preferably not threaded. It can be appreciated that the threads on the top and bottom would not necessarily align in a way that would permit a rod threaded to the top to then thread into the base. Second, the mating face of the top is pointed downwardly and the circular segments extend downwardly past the square section. Third, the circular segments are located at the left and right sides rather than the front and rear. Fourth, the outer upper edge of the circular segments are preferably rounded slightly to provide a smoother movement through the pipe and to provide a smoother finished opening. It is understood that the orientation terms are arbitrary and that they are used simply to indicate that the two parts mate when oriented transverse to each other.

4. The Two Piece Pulling Member

Figure 11:
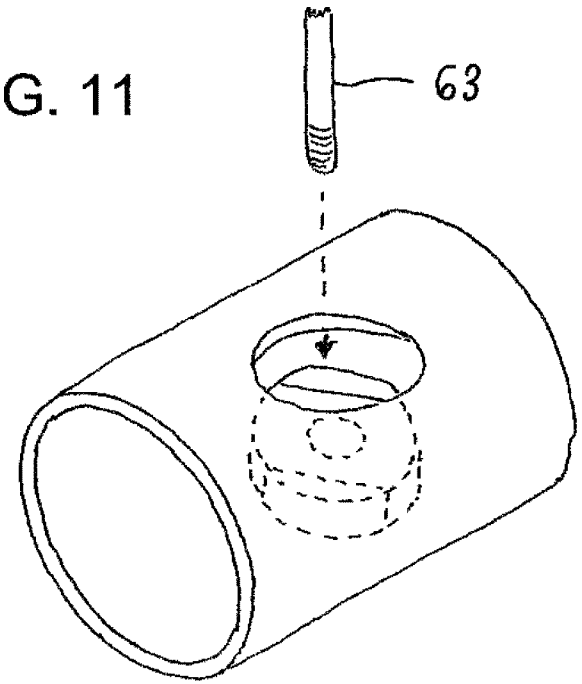
FIG. 11 is a simplified perspective view of a subsequent step thereof.
Figure 10:
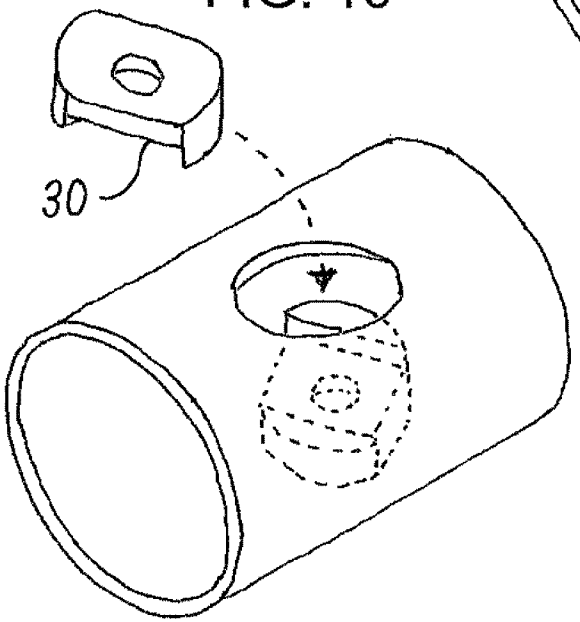
FIG. 10 is a simplified perspective view of a subsequent step thereof.
Figure 9:
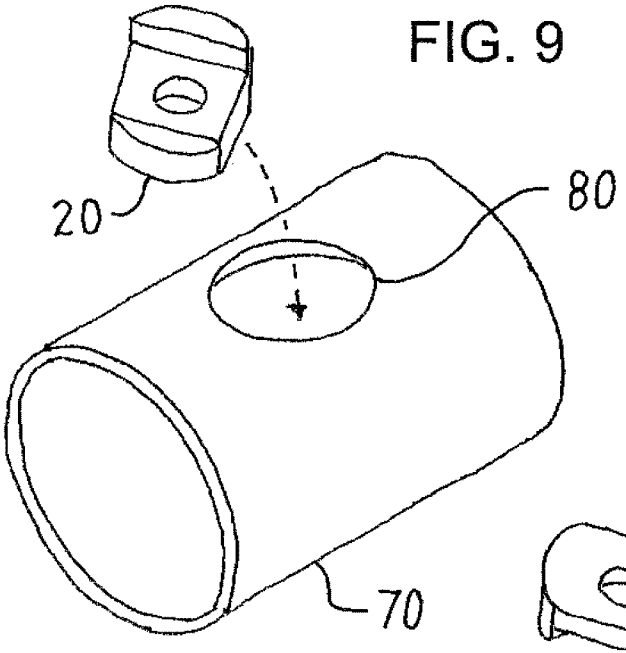
FIG. 9 is a simplified perspective view of a step in the installation of a branched pipe using the pulling member of this invention.

When the top and the base are aligned and combined, they form a generally cylindrical pulling member that functions as an integral unit. Referring to FIGS. 9 to 11, the alignment and combination are shown in simplified fashion. In FIG. 9, the base is shown being inserted through the hole in the pipe. As shown, the base must be placed on its side to fit through the hole. In FIG. 10, the top is shown being inserted through the hole 80 in the pipe 70. In FIG. 11, the top and the base are combined inside the pipe and are about to be attached to a pulling rod.

As previously mentioned, the upper surface and lower surface of the pulling member are generally flush. The outer upper edge of the pulling member is preferably slightly rounded to facilitate the deformation of the side wall as the pulling member is pulled through the hole in the main pipe. The diameter of the combined pulling unit is a matter of choice that depends on the desired size of the opening to be formed in the side wall of the pipe.

The two piece pulling member is most easily used when the hole in the side wall of the main pipe is sufficiently large for a worker's hand to fit through it for easy alignment of the top onto the base. The diameter of the pulling member is generally about three to twelve inches. If the hole and pulling member are too small, aligning the top onto the base inside the main pipe must be performed with a tool. Similarly, if the hole and pulling member are too large, the base and top are heavy and aligning the top onto the base inside the main pipe becomes difficult. The depth of the pulling member is also a matter of choice. If the depth is too great, the top and base will not pass through the hole in the side wall. If the depth is too little, the circular segments of the base may bend downwardly as the pulling member passes through the hole.

The top and the base are made of a durable material. The preferred material is steel.

5. Alternate Embodiments

When a relatively small diameter opening is formed in a pipe having a relatively thick wall, it can be appreciated that the pulling member is relatively small. It can also be appreciated that parts of the pulling member are subjected to extreme forces as it is pulled through the pipe. Depending on many factors, including the material used for the pulling member, such forces can cause deformation or failure. Deformation is most likely to occur at the circular segments of the base. To resist such deformation, reinforcing ribs are added to the bottom of the base if desired. The reinforcing ribs are sized so they do not prevent the base from passing through the hole.

Failure is most likely to occur if the pulling rod pulls through the threads of the base, sometimes known as thread shearing or thread stripping. To resist such failure, additional threads are desirable. Alternate embodiments of the base 120 and the top 130 are shown in FIGS. 17 to 22. The base contains a sleeve portion 125 that extends upwardly from the center of the face. The internal threads of the sleeve portion are omitted for illustration in FIGS. 17 to 19. A mating opening 132 is present in the top of the pulling member. The threaded sleeve effectively doubles the depth of threads when compared to the base shown in FIG. 5.

6. The Assembly

The pulling member is generally used as part of a pulling tool subassembly that includes a pulling rod and a pulling tool. Hydraulic cylinders are commonly used in fixed locations like a machine shop or fabrication facility as pulling tools to pull one piece pulling members through a main pipe. In a long run of pipe in the field where the pulling member of this invention is typically used, various modifications are necessary. First, a support is required for temporary attachment to the main pipe at the location where the opening is to be formed. Second, a cutting tool is required for connection to the support. Third, a pulling tool is also required for connection to the support.

Figure 12:
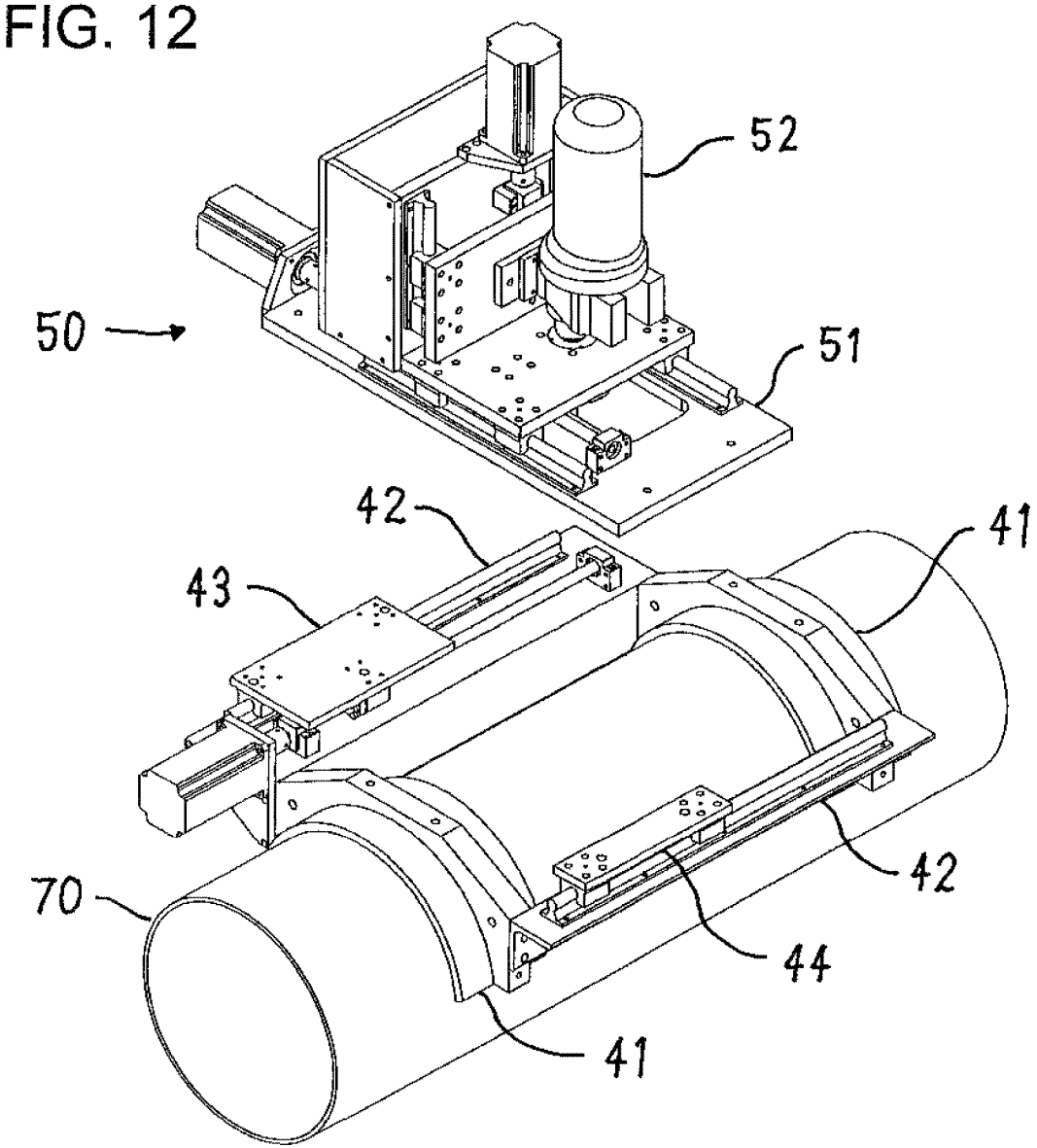
FIG. 12 is a perspective view of a step in the installation of a branched pipe using the pulling member of this invention.

Referring to FIG. 12, a preferred support 40 has two spaced apart transverse saddles 41 that rest on the main pipe, two outboard longitudinal rails 42, and slides 43 and 44 that move longitudinally on the rails along the main pipe. As discussed in detail below, this support accommodates either a cutting tool subassembly 50 or a pulling tool subassembly 60.

7. The Method

The use of the pulling member to form a branch opening with a shoulder in a side wall of a malleable pipe. If a hole in the pipe is not already made, the cutting tool subassembly 50 is mounted on the support resting on the pipe 70 as shown in FIG. 12. The cutting tool subassembly includes a pedestal 51, a motor 52 mounted on the pedestal, and an end cutting milling blade (not seen) attached to the motor. The movement of the cutting tool subassembly is preferably computer controlled so the position of the blade can be fixed with precision in the x, y, and z axes. After the hole 80 is cut, the cutting tool subassembly is removed from the support. The hole has a size slightly less than the size of the desired finished opening. As previously discussed, the hole is generally elliptical, but other shapes are also suitable.

Figure 13:
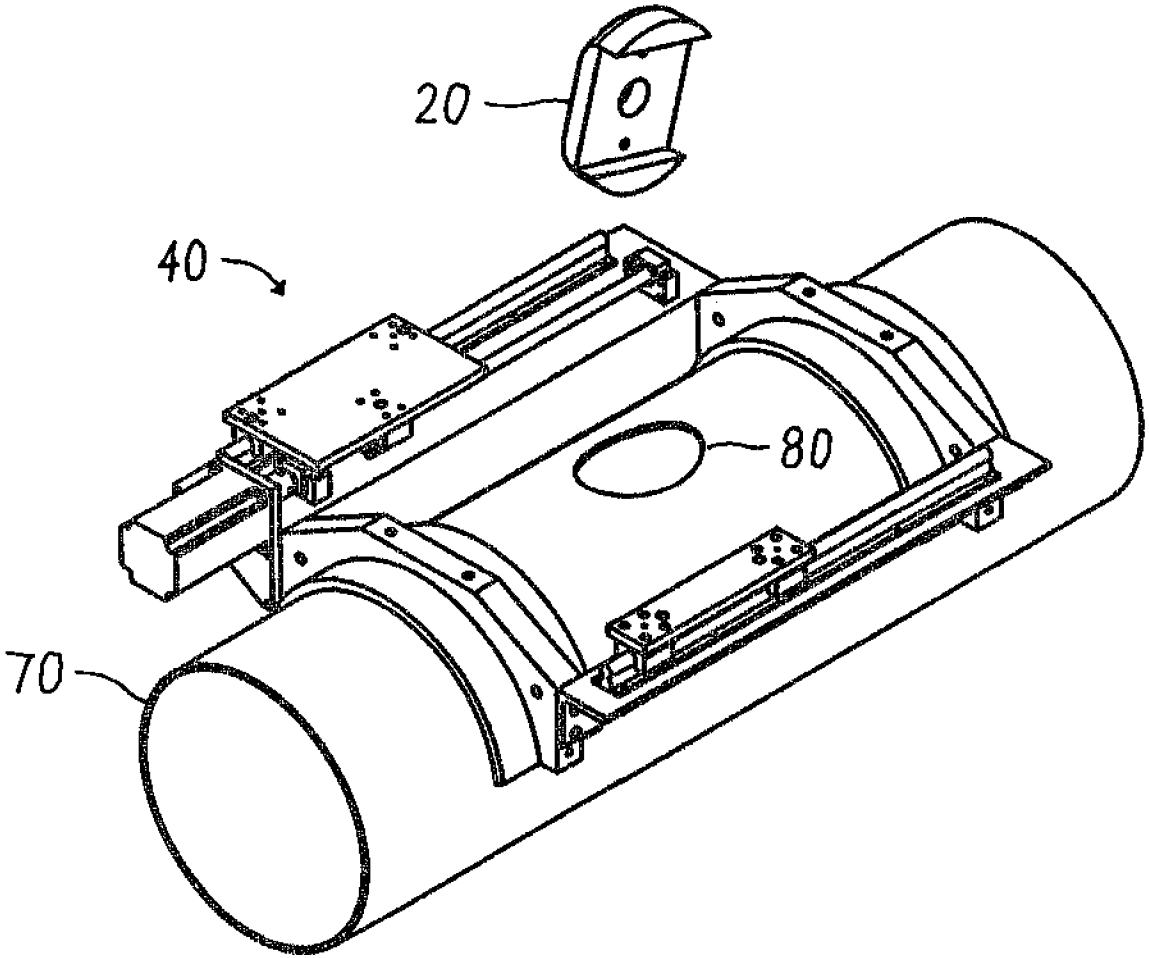
FIG. 13 is a perspective view of a subsequent step thereof.
Figure 15:
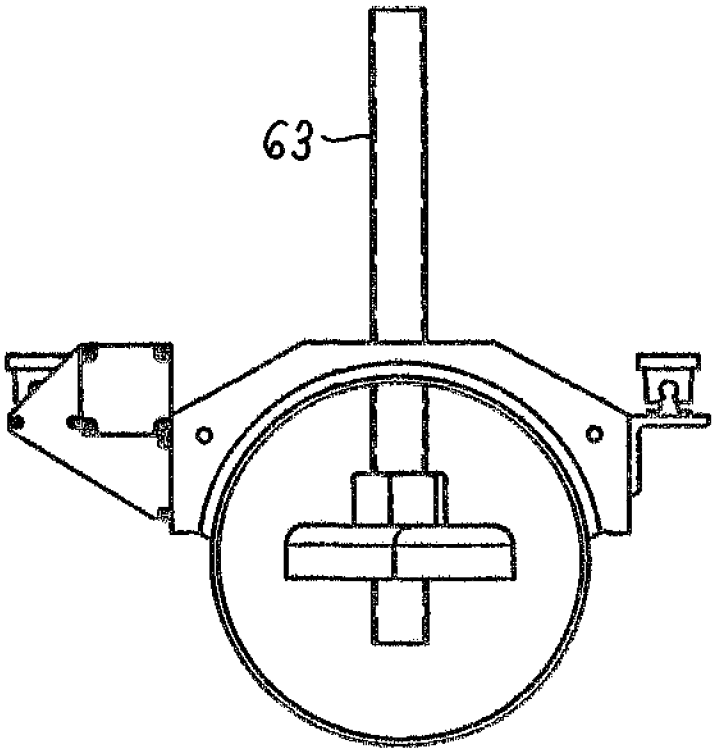
FIG. 15 is an end elevation view of a subsequent step thereof.
Figure 14:
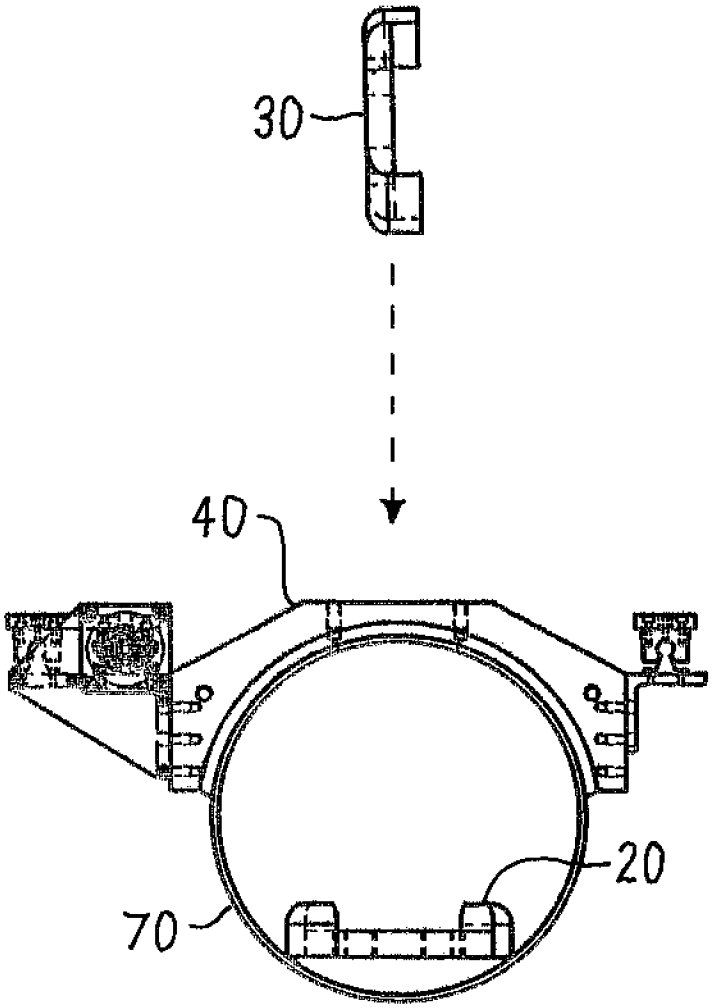
FIG. 14 is an end elevation view of a subsequent step thereof.

Referring to FIG. 13, the next step is to insert the base of the pulling member through the hole 80. As previously mentioned, the base must be oriented on its side as shown to fit through the hole. After fitting through the hole, the base is placed at the bottom of the pipe directly below the opening with its interior face pointing upwardly. Referring to FIG. 14, the next step is to insert the top of the pulling member through the hole. The base and the top are then aligned with the interior face of the base and the interior face of the top in contact to form a combined cylindrical pulling member. Referring to FIG. 15, the next step is to insert the pulling rod through the opening and connect it to the pulling member by threading or other suitable means. In FIGS. 14 and 15, the pulling member is shown larger relative to the pipe for illustration purposes.

Figure 16:
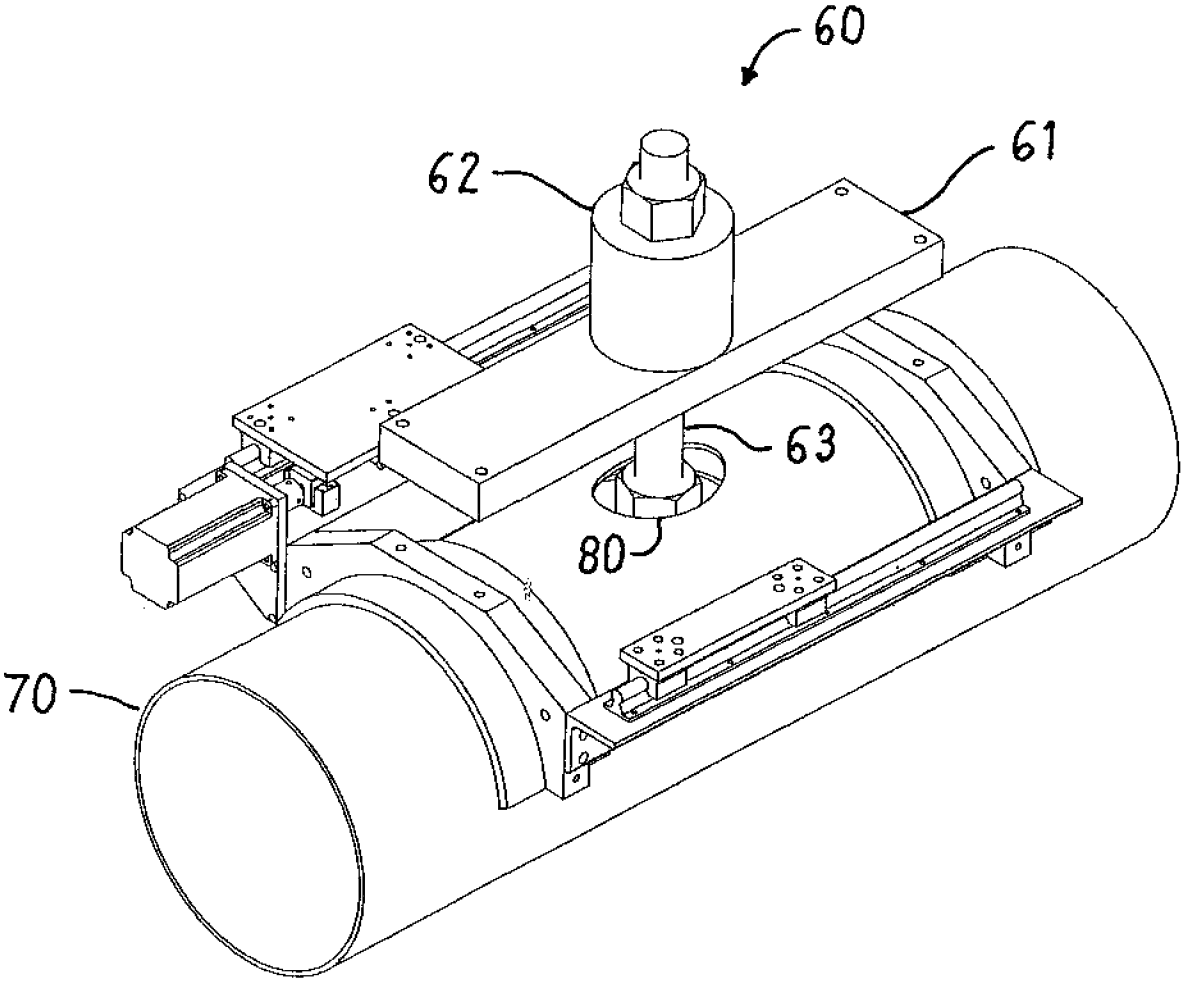
FIG. 16 is a perspective view of a subsequent step thereof.
Figure 19:
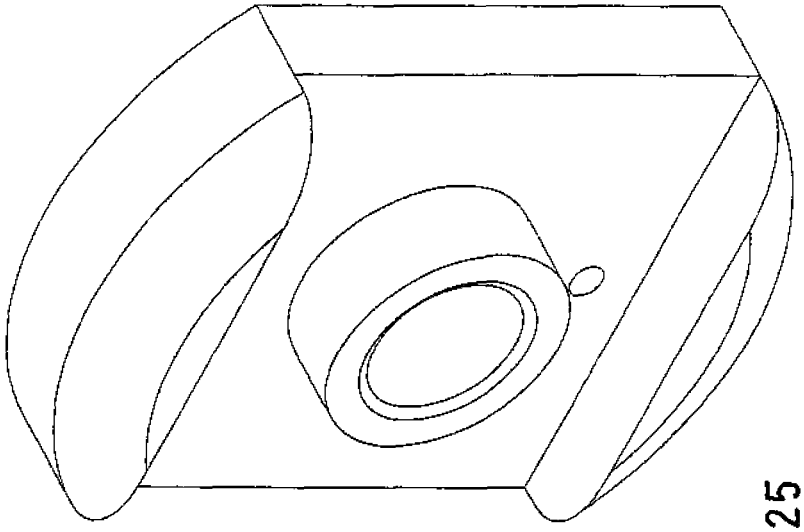
FIG. 19 is a perspective view thereof.
Figure 18:
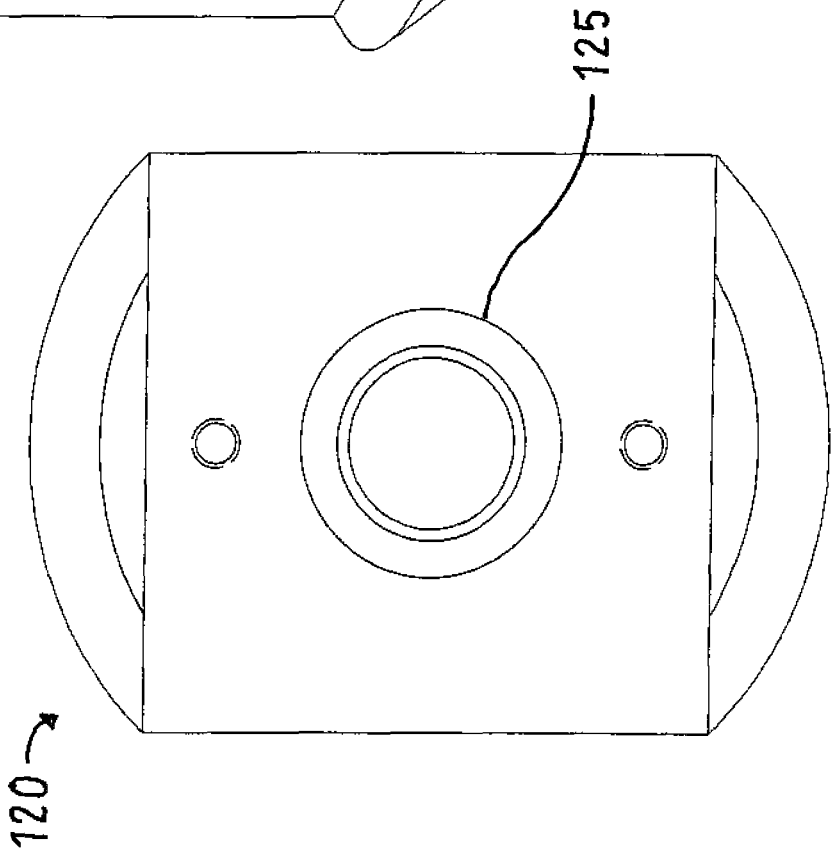
FIG. 18 is a top view thereof.
Figure 17:
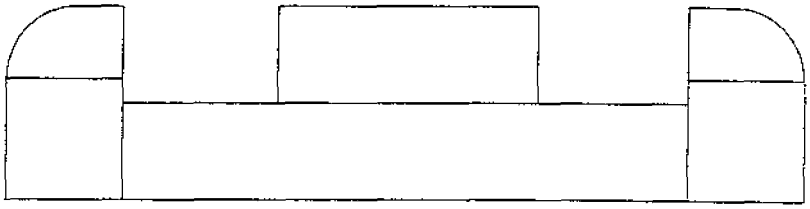
FIG. 17 is a side view of an alternate embodiment of the base of the pulling member.
Figure 22:
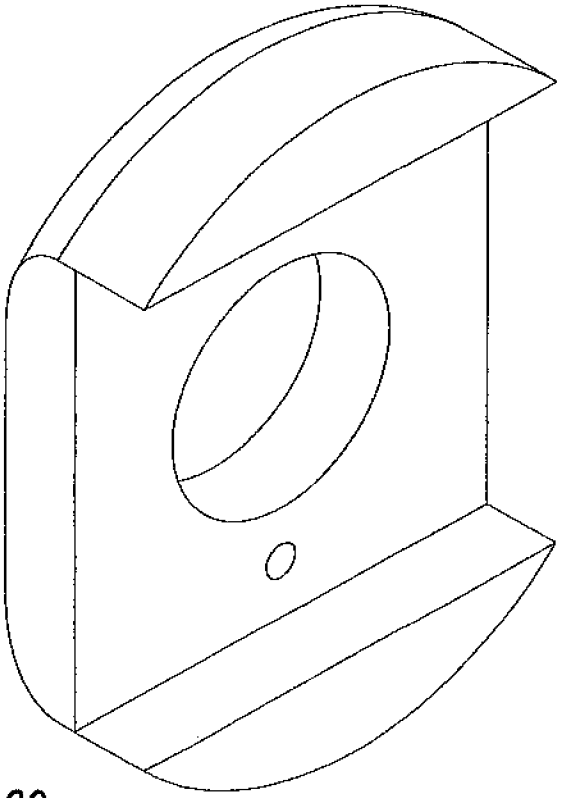
FIG. 22 is a perspective view thereof.
Figure 21:
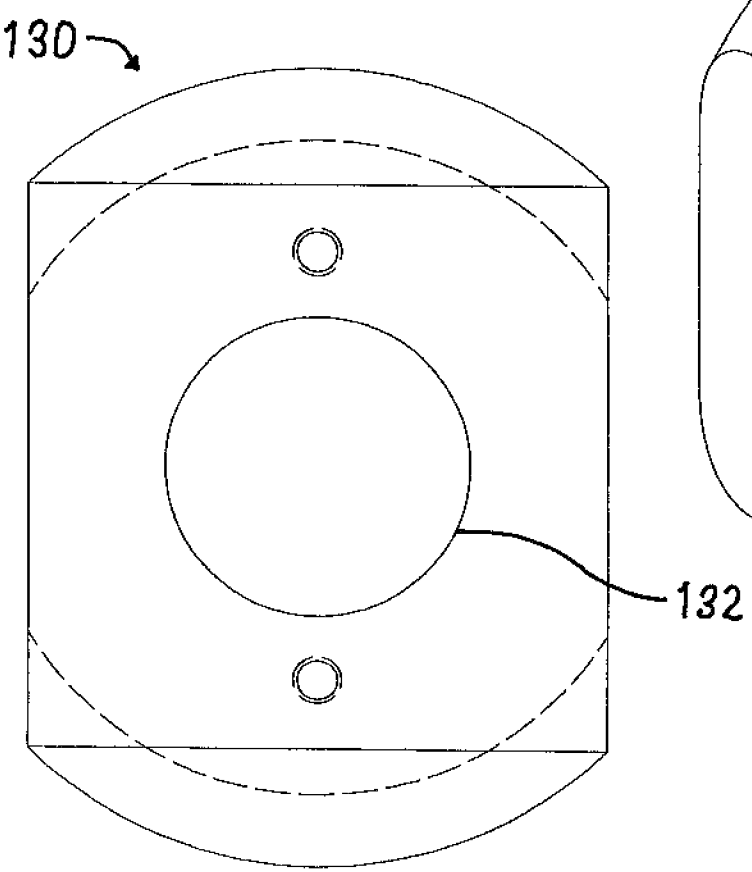
FIG. 21 is a bottom view thereof.
Figure 20:
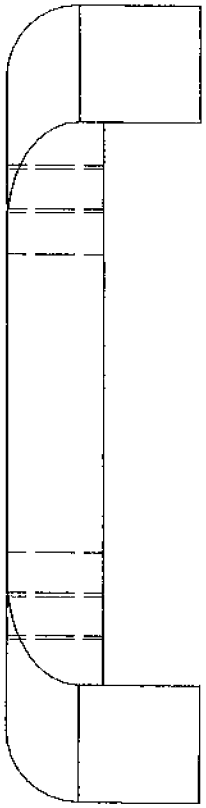
FIG. 20 is a side view of an alternate embodiment of the top of the pulling member.

Referring to FIG. 16, the next step is to place the pulling tool subassembly 60 having a pedestal 61 and a hydraulic motor 62 onto the support and connect the pulling rod 63. The pedestal of the pulling tool subassembly is mounted to the saddles and remains stationary during the pulling. The next step is to pull the pulling member through the hole and thereby form the branched opening 90 with a shoulder. The opening formed using the two piece pulling member of this invention is identical to the opening formed using a conventional one piece pulling member. Each formed opening has a shoulder and is adapted for connection to a branched pipe by welding.

8. Advantages

As previously mentioned, the two piece pulling member enables the opening to be formed at any place along the main pipe because the pulling member does not need to be inserted from an end of the main pipe. In other respects, the two piece pulling member performs similarly to a conventional one piece pulling member.

I claim:

1. A two piece cylindrical pulling member for forming a branched opening with a shoulder in a side wall of a malleable pipe when pulled by a pulling rod, the pulling member having a radius and a depth and comprising:

(a) a base having: (i) a square portion having an upwardly facing interior face, a central opening, front and rear opposed ends, and a depth about 50 percent of the depth of the pulling member; and (ii) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (b) a top having: (i) a square portion having a downwardly facing interior face, a central opening, left and right opposed ends, and a depth about 50 percent of the depth of the pulling member; and (ii) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder.

2. The pulling member of claim 1 additionally comprising: (c) a means for attaching the pulling member to a pulling rod.

3. The pulling member of claim 2 wherein the base has a central circular threaded opening and the top has a central unthreaded circular opening.

4. The pulling member of claim 3 wherein the base has a central internally threaded sleeve portion extending upwardly from the face.

5. An assembly for forming a branched opening with a shoulder in a side wall of a malleable pipe, the assembly comprising:

(a) a two piece pulling member having a radius and a depth and comprising: (i) a base having: (1) a square portion having an upwardly facing interior face, a central opening, front and rear opposed ends, and a depth about 50 percent of the depth of the pulling member; and (2) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (ii) a top having: (1) a square portion having a downwardly facing interior face, a central opening, left and right opposed ends, and a depth about 50 percent of the depth of the pulling member; and (2) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder; and (b) a pulling tool subassembly comprising: (i) a pulling rod for attachment to the pulling member; and (ii) a pulling tool for applying a pulling force to the pulling rod to pull the pulling member through a hole in a side wall of a malleable pipe to form a branched opening with a shoulder.

6. The assembly of claim 5 wherein the base of the pulling member has a central circular threaded opening, the top of the pulling member has a central circular unthreaded opening, and the pulling rod has a threaded distal end that mates with the central threaded opening of the base.

7. The assembly of claim 5 additionally comprising: (c) a cutting tool subassembly comprising: (i) a blade for cutting a hole in the side wall of a malleable pipe; and (ii) a motor for moving the blade.

8. The assembly of claim 7 additionally comprising a support for resting upon the pipe and for supporting either the pulling tool subassembly or the cutting tool subassembly, the support comprising two transverse saddles and two longitudinal rails.

9. A method for forming a branch opening with a shoulder in a side wall of a malleable pipe, the method comprising:

(a) obtaining a malleable pipe with a hole in a side wall;

(b) obtaining a two piece pulling member having a radius and a depth and comprising: (i) a base having: (1) a square portion having an upwardly facing interior face, a central circular opening, front and rear opposed ends, and a depth about 50 percent of the depth of the pulling member; and (2) two upwardly extending circular segment portions at the front and rear opposed ends with a depth equal to the depth of the pulling member, the circular segments defining parallel opposed chords and having an apothem about 71 percent of the radius of the pulling member and having an arc length of about 90 degrees; and (ii) a top having: (1) a square portion having a downwardly facing interior face, a central circular opening, left and right opposed ends, and a depth about 50 percent of the depth of the pulling member; and (2) two downwardly extending circular segment portions at the left and right opposed ends with a depth equal to the depth of the pulling member, the circular segments defining parallel opposed chords and having an apothem about 71 percent of the radius of the pulling member and having an arc length of about 90 degrees, such that the top fits onto the base with the interior face of the base and the interior face of the top in contact to form a cylinder; and;

(c) inserting the base of the pulling member through the hole in the pipe;

(d) inserting the top of the pulling member through the hole in the pipe;

(e) fitting the top of the pulling member onto the base of the pulling member with the interior face of the base and the interior face of the top in contact to form the pulling member;

(f) attaching a pulling rod to the pulling member; and (g) pulling on the pulling rod to pull the pulling member through the hole to form a branched opening with a shoulder.

10. The method of claim 9 wherein the base of the pulling member has a central threaded opening, the top of the pulling member has a central opening, and the pulling rod has a threaded distal end that mates with the central threaded opening of the base.

11. The method of claim 9 wherein the pulling rod is part of a pulling tool subassembly comprising a motor, wherein the pulling tool subassembly is mounted onto a support resting on the pipe, and wherein the support comprises two transverse saddles and two longitudinal rails.

* * * * *